US005114753A

United States Patent [19]

Shibata et al.

[11] Patent Number: 5,114,753

[45] Date of Patent: May 19, 1992

[54] METHOD AND APPARATUS FOR COATING WEB WHILE PREVENTING CONTACT OF EDGE PORTIONS THEREOF WITH COATING HEAD

[75] Inventors: Norio Shibata; Tsunehiko Sato; Naoyoshi Chino; Yasuhito Hiraki, all of Kanagawa, Japan

[73] Assignee: Fuji Photo Film Co., Ltd., Kanagawa, Japan

[21] Appl. No.: 777,628

[22] Filed: Oct. 16, 1991

Related U.S. Application Data

[63] Continuation of Ser. No. 454,237, Dec. 21, 1989, abandoned.

[30] Foreign Application Priority Data

Dec. 21, 1988 [JP] Japan ..... 63-320546
Feb. 16, 1989 [JP] Japan ..... 1-34940

[51] Int. Cl.[5] ..... B05D 5/00; B05D 1/26; B05C 3/18; B05C 3/20

[52] U.S. Cl. ..... 427/286; 427/128; 427/256; 427/288; 427/287; 118/407; 118/419

[58] Field of Search ..... 427/172, 286, 288, 434.3, 427/128, 256, 287, 407, 419; 118/406, 410, 411, DIG. 2

[56] References Cited

U.S. PATENT DOCUMENTS 4,025,671 5/1977 Creamer ..... 427/286
4,907,530 3/1990 Shibata et al. ..... 118/410

*Primary Examiner*—Evan Lawrence
*Attorney, Agent, or Firm*—Sughrue, Mion, Zinn, Macpeak & Seas

[57] ABSTRACT

A coating material and apparatus in which the edge portions of the web being coated are supported off the edge portions of the coating head. In one embodiment, recesses are formed in the edge portions of the coating head, while in another embodiment a fluid is jetted towards the edge portions of the web. With the invention, scratching and the like of the edge portions of the web are eliminated, and the web is coating to a uniform thickness in the width direction thereof.

24 Claims, 3 Drawing Sheets

METHOD AND APPARATUS FOR COATING WEB WHILE PREVENTING CONTACT OF EDGE PORTIONS THEREOF WITH COATING HEAD

This is a continuation of application Ser. No. 07/454,237 filed Dec. 21, 1989, abandoned.

BACKGROUND OF THE INVENTION

The present invention relates to a method for coating a flexible support (hereinafter referred to as a "web") made of plastic film, paper, metal foil, or the like with a coating solution such as a photographic photosensitive solution, magnetic solution, surface protective solution or the like, and an apparatus for practicing the method.

Examples of a conventional coating apparatus of this type are a roll-type coating apparatus, a bead-type coating apparatus, a slide-type coating apparatus, and an extrusion-type coating apparatus. In all of these coating apparatuses, the width of the coating head is larger than the width of the web being coated, and the width of the coated area on the web is less than the width of the web. Hence, when the web is coated with such an apparatus, the web will have portions along both its edges on which no coating solution is applied. (These areas are hereinafter referred to as "coating-solution-free portions" when applicable.) The coating-solution-free portions are each typically about five or six millimeters to about fifteen or sixteen millimeters in width.

In the case of an extrusion-type coating apparatus, such as disclosed by Japanese Unexamined Published Patent Applications Nos. 84771/1982 and 94657/1984, a running web is coated with a coating solution with a coating head pushed against it. Since the gap between the web and the coating head is extremely small, the above-described coating-solution-free portions are brought into contact with the coating head.

As a result, the coating-solution-free portions of the web are scraped by the coating head, thus causing the generation of fine scrapings. These scrapings have a tendency to stick to both ends of the coating edges of the coating head. In addition, foreign matter on the surface of the web may be caught by the coating edge of the coating head.

These waste materials accumulated at both ends of the coating edge raise both edges of the web. As a result, the thickness of the coating solution applied to the web is not uniform in the widthwise direction. In other words, the resultant layer on the web is thicker in both edge regions than in the middle region. This difficulty is especially noticeable when the coating layer is thin (a coating quantity of 30 cc/m$^2$ or less) or when the coating rate is high (200 mm/min or higher).

In order to overcome the above-described difficulty, in a coating method disclosed in Japanese Unexamined Published Patent Application No. 257268/1986, before a coating solution is applied to a flexible support, a solvent is applied to both edge regions of the support located at both sides of the region which is to be coated with a coating solution (i.e., the aforementioned coating-solution-free portions). That is, a pre-coating layer is formed in the coating-solution-free regions. For the same purpose, Japanese Unexamined Published Patent Application No. 257263/1986 has disclosed a coating apparatus in which the top of a doctor edge confronted with the coating width regulating board is chamfered.

However, the coating method disclosed by the Japanese Unexamined Patent Application No. 257268/1986 is still disadvantageous in that, because of external disturbances such as the fluttering or meandering of the web which may be caused when it is run, the solvent is liable to run into the coating region of the web which is or to flow over to the other side of the web. That is, the coating solution may be applied nonuniformly to the web. Also, the pre-coating layers are increased in width by the back edge and the doctor edge (provided on the coating head end). Therefore, if the coating-solution-free portions are relatively small in width, or the scraping force of the doctor edge is large, then it is rather difficult to suitably control the applied width of the solvent.

If the above-described difficulty of the solvent flowing out of the coating-solution-free regions of the web occurs in the manufacture of a magnetic recording medium, the magnetic coating solution will adhere to the conveying rolls driving the nonmagnetic support of the web, thus smudging the nonmagnetic support and the calender roll in the following surface treatment section. As a result, the surface of the support is often scratched in the surface treatment section by foreign matter. Thus, the resultant product often has unsatisfactory magnetic characteristics.

The coating apparatus disclosed by Japanese Unexamined Published Patent Application No. 257263/1986 is also disadvantageous in that it is impossible to prevent the coating-solution-free portions of the web from being brought into contact with the back edge, and the back edge scrapes the support or catches foreign matter. Especially if the web is thin (40 μm or less), it is low in rigidity, and accordingly both edge portions are strongly bent toward the ends of the coating head. As a result, the edge portions of the web are brought into contact with the edges of the slope or step formed at the ends of the coating head, whereby the web may be scraped.

In order to eliminate the drawbacks accompanying the above-described coating methods and coating apparatuses, Japanese Patent Application No. 201996/1988 has disclosed a coating apparatus in which slopes or steps are formed in the two end portions of the coating head which confront the coating-solution-free portions of the flexible support. The slopes or steps are spaced away from the flexible support, i.e. they extend from the middle of each of the end portions of the coating head toward both sides, so that there are gaps between the end portions of the coating head and the coating-solution-free portions of the flexible support. The apparatus can eliminate the difficulties of the coating-solution-free portions of the flexible support being scraped by the coating head and foreign matter on the flexible support being caught by both end portions of the coating head.

However, in the case where the web is thin (15 to 40 μm in thickness) and hence low in rigidity, both edge portions of the web have a strong tendency to bend towards the ends of the coating head. As a result, the end portions of the web are brought into contact with the slopes or steps provided at the ends of the coating head, whereby the web may be scraped.

Recently, sometimes webs for VTR (video tape recorder) magnetic recording media employ a PET (polyethylene terephthalate) base to which is added a filler of spherical $SiO_2$ material in order to reduce the contact resistance of the manufactured magnetic recording media with contacting components in the VTR, such as guide poles and the like, thereby to permit more stable running of the magnetic recording media. On the other hand, a PET base with added filler is lower in rigidity. Therefore, in applying a coating solution to such a base with the above-described coating apparatus, both edge portions of the PET base are liable to strongly bend towards the ends of the coating head. When the PET base is brought into contact with the end portions of the coating head, the filler is liable to be removed therefrom, and the resulting scrapings from the web tend to accumulate at the end portions of the coating head.

SUMMARY OF THE INVENTION

Accordingly, an object of the present invention is to eliminate the above-described difficulties accompanying the above-described coating apparatuses. More specifically, an object of the invention is to provide a coating method and apparatus in which, even if the web to be coated is relatively thin and accordingly flexible, a coating layer can be formed on the web which is uniform in thickness and excellent in surface quality, and the coating solution is inhibited from flowing over the web. Another object of the invention is to provide a coating apparatus for practicing such a coating method. Still another object of the invention is to provide a coating apparatus which is capable of forming a coating layer uniform in thickness and excellent in surface quality on a belt-shaped flexible support which is free from the difficulty of the solvent applied to the support spreading out over the support.

The foregoing and other objects of the invention have been achieved by the provision of a coating method in which a coating solution is applied to a flexible support which runs continuously past the slot of a coating head abutted against the flexible support, in which, according to the invention, the coating solution is applied to the flexible support while the edges of the flexible support are being supported so that, of both edge portions of the flexible support to which no coating solution is applied, at least the parts which are close to the coating portion of the flexible support may are prevented from being in sliding contact with the two ends of the coating head.

That is, the coating solution is applied to the flexible support with a coating apparatus in which, according to the invention, a pair of recesses are provided at both ends of the coating head in such a manner that the recesses confront with both edge portions of the flexible support to which no coating solution is applied, extending in the direction of running of the flexible support, and a pair of shoulders are provided, defining the recesses at the ends of the coating head, the shoulders supporting both edges of the flexible support.

The foregoing and other objects of the invention have also been achieved by the provision of a coating apparatus in which a coating solution is applied to a belt-shaped flexible support which runs continuously, with the slot of a coating head abutted against the flexible support, in which, according to the invention, a pair of fluid jetting outlets for jetting fluid towards both edges of the belt-shaped flexible support are provided at both end portions of the coating head which confront the two edge portions of the belt-shaped flexible supports to which no coating solution is applied, the fluid jetted through the fluid jetting outlets spacing the edge portions of the belt-shaped flexible support away from the end portions of the coating head to prevent the edge portions of the belt-shaped flexible support from being brought into contact with the end portions of the coating head.

That is, in accordance with this aspect of the coating apparatus of the invention, fluid jetting outlets are provided at the end portions of the coating head which confront the edge portions of the belt-shaped flexible support so as to jet fluid towards the edges of the latter, and the fluid jetted through the fluid jetting outlets acts to space the edge portions of the flexible support away from the end portions of the coating head in applying the coating solution to the flexible support.

The fluid may be a gas such as compressed air, or a liquid such as a solvent, or other another material which will not adversely affect the coating solution.

DESCRIPTION OF THE PREFERRED EMBODIMENTS

Figure 1:
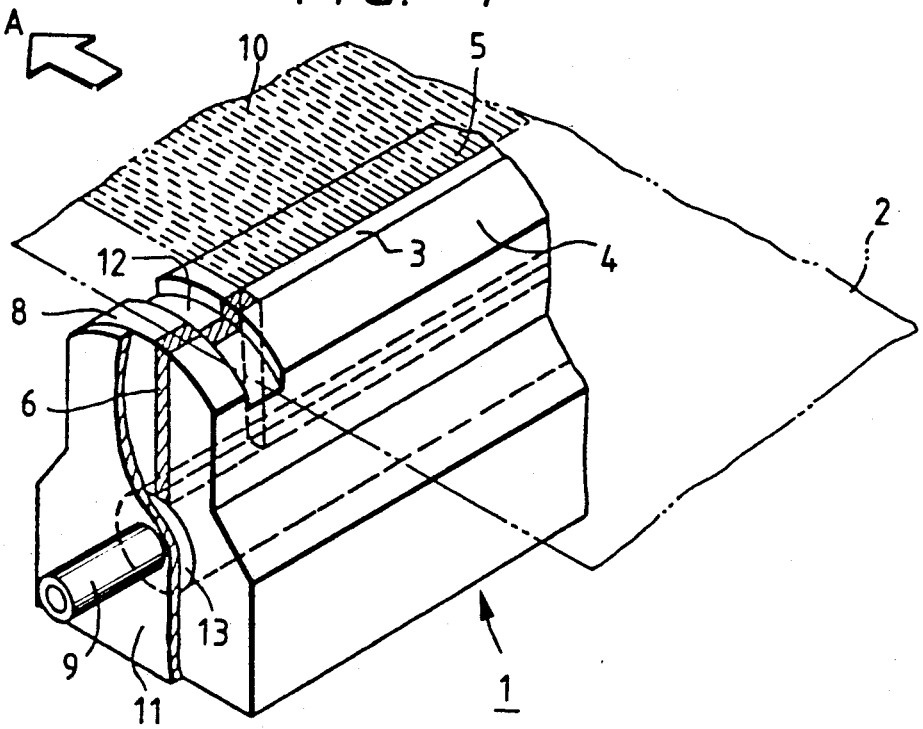
FIG. 1 is a perspective view showing an extrusion-type coating head in a coating apparatus constructed according to a preferred embodiment of the invention.

FIG. 1 is a perspective view of an extrusion type coating head in a coating apparatus according to this invention.

As shown in FIG. 1, a coating head 1 is larger in width than the flexible support (web) 1 to be coated. The coating head 1 has a back edge 4 and a doctor edge 5 which form a slot 3 for discharging a coating solution 15 over the width of the web. The slot 3 is communicated with a coating solution pool 13 provided inside the coating head 1. In order to supply the coating solution 15 into the coating solution pool 13, a coating solution supplying outlet 9 is provided in a side board 11 disposed beside the coating solution pool 13. Hence, the coating solution 15 thus supplied is discharged through the slot 3 under a uniform pressure over its width.

Two regulating boards 6 are provided at the two ends of the slot 3 to define a coating width, that is, to prevent the application of the coating solution beyond the coating width. Accordingly, the web will have coating-solution-free portions along its edges.

A pair of recesses 12 rectangular in section are formed in the surfaces of the two end portions of the back edge 4 and of the doctor edge 5, which correspond to the coating-solution-free portions of the web 2, in such a manner that the recesses 12 extend in the direction A of running of the web 2, thus providing shoulders 8 to the outside of the recesses. The shoulders 8 serve to support the two edge portions of the web.

With the coating apparatus according to the invention, a polyethylene terephthalate support 15 μm in thickness and 500 mm in width was coated with a magnetic coating solution under coating conditions in which the coating quantity was 17 cc/m$^2$, the coating rate was 250 m/min, the coating tension was 20 kg/m, and the coating width was 485 mm. The magnetic coating solution was prepared by mixing and dispersing a magnetic coating solution is as indicated in the following Table 1 in a ball mill for 10.5 hours. The viscosity of the magnetic coating solution thus prepared was measured with a ring-cone-type viscosimeter as 19 poise with a shear rate of 700 $sec^{-1}$.

Under the above-described coating conditions, a magnetic recording medium 8000 m in length was manufactured. The coating-solution-free portions of the support were observed for scraping, and the thicknesses of both end portions of the layer formed on the support with respect to the average thickness (hereinafter referred to as "thickness ratios") were measured. The results of observation and measurement are indicated as Inventive Example 1 in the following Table 2. In this case, the recesses rectangular in section formed in the end portions of the extrusion-type coating head were 2.0 mm long in the direction of coating width and 0.05 mm in depth, and the shoulders 8 were 5 mm in support length.

TABLE 1

| Composition | |
|---|---|
| $\Gamma$-$Fe_2O_3$ (0.6 μm average grain size in direction of major diameter, $H_c$ = 320 Oe) | 300 parts by weight |
| Vinyl chloride - Vinyl acetate copolymer (copolymer ratio 87:13, polymerization degree 450) | 40 parts by weight |
| Electrically conductive carbon | 20 parts by weight |
| Stearic acid | 7 parts by weight |
| Silicon oil | 3 parts by weight |
| Solvent | |
| xylole | 300 parts by weight |
| methyl isobutyl ketone | 400 part by weight |

In addition, a coating apparatus as disclosed in Japanese Unexamined Published Patent Application No. 257263/1986 in which the top of the doctor edge is chamfered and a coating apparatus as disclosed in Japanese Patent Application No. 201996/1988 in which surfaces sloped at 5° were formed at both ends of the extrusion-type coating head were used to manufacture magnetic recording media 8000 m in length, similar to the above-described case. As above, the coating-solution-free portions of the support were observed for scraping, and the thicknesses of both end portions of the layer formed on the support with respect to the average thickness thereof (thickness ratios) were measured. The results of these observations and measurements are indicated as Comparison Examples 1 and 2, respectively, in the following Table 2:

TABLE 2

| Specimen | Scraping | Thickness Ratio (%) |
|---|---|---|
| Inventive Example 1 | A | 0 |
| Comparison Example 1 | B | 4 |
| Comparison Example 2 | C | 12 |

Legend:
A: The surface was not scratched or scraped at all - medium satisfactory
B: The surface was scratched - medium slightly unsatisfactory
C: The surface was scraped, forming scrapings - medium unsatisfactory That is, in the case of the invention wherein the coating-solution-free portions of the web 2 located to the outside of the coating layer 10 never contact the back edge 4 and the doctor edge 5 of the coating head 1, the coating apparatus of the invention is free from the difficulties that occur when the coating-solution-free portions of the web 2 are scraped by the back edge 4 and the doctor edge 5 and foreign matter on the web 2 is caught by the end portions of the back edge 4 and of the doctor edge 5 of the coating head 1 close the coating layer 10. That is, the coating apparatus of the invention is free from the difficulty of foreign matter accumulating on the edge portions of the coating layer 10 and raising the edge portions so that the thickness of the coating solution applied to the web, and accordingly the resultant coating layer, is not uniform in the widthwise direction of the web.

Figure 2:
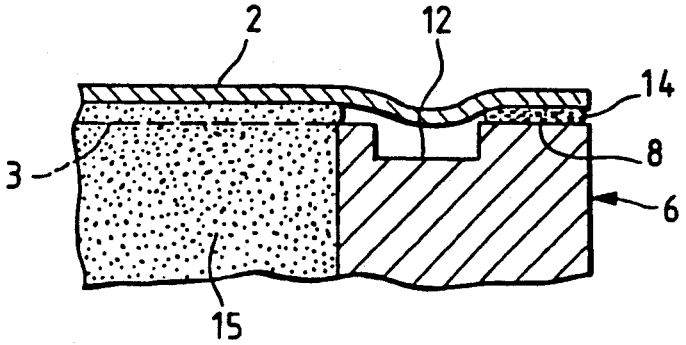
FIG. 2 is a sectional view showing a part of the extrusion-type coating head of FIG. 1.

As described above, the recesses 12 are formed in both end portions of the coating head 1, thus providing the shoulders 8, as shown in FIG. 2. The web 2 is run with both edge portions thereof being held by the shoulders 8. Hence, even in the case where the web is relatively thin and accordingly low in rigidity, the difficulty of the edge portions of the web 2 being strongly flexed towards the ends of the coating head, whereby the edge portions of the web close to the coating layer 10 are brought into contact with the end portions of the coating head thus forming scrapings can be prevented because the edge portions of the web are supported in the above-described manner.

On the other hand, since the edge portions of the web are brought into contact with the shoulders 8, in some cases they may be scraped, thus adversely affecting the coating layer 10. This difficulty may be eliminated by increasing the length of each recess in the direction of coating width, or by increasing the length of the web-supporting part of each shoulder 8 thereby to prevent the web from being bent. Preferably, as shown in FIG. 1, a solvent 14 such as butyl acetate or methylethyl ketone is applied to the web-supporting surface of each of the shoulders 8, and the lubricating effect of the solvent prevents the web from being scraped.

An extrusion-type coating head constructed in accordance with another embodiment of the invention will now be described with reference to FIG. 3.

Figure 3:
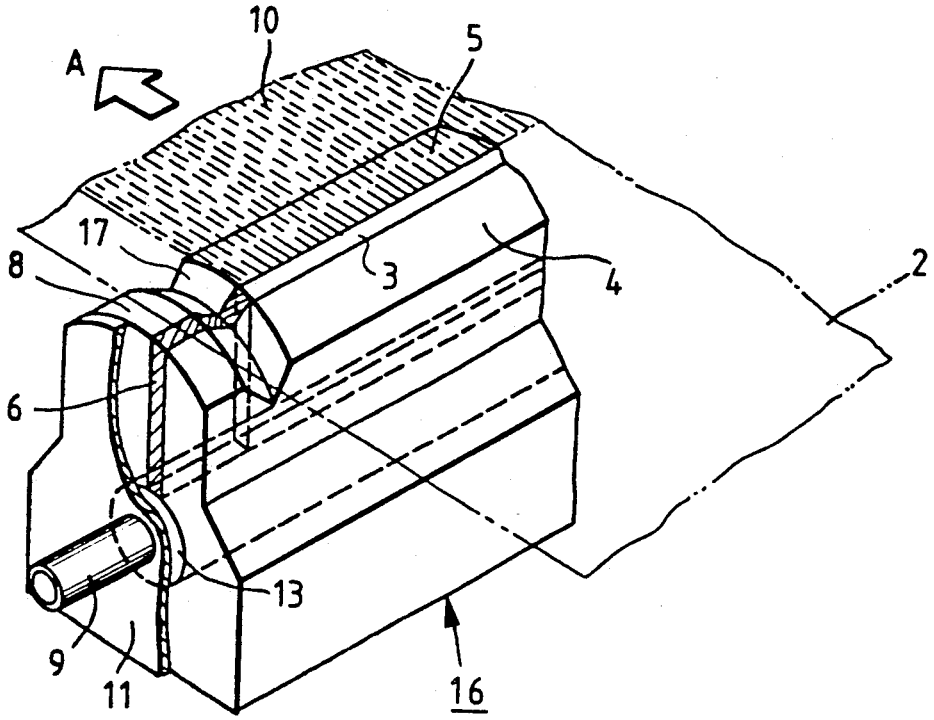
FIG. 3 is a perspective view showing an extrusion-type coating head in a coating apparatus of another embodiment of the invention.

As shown in FIG. 3, the extrusion-type coating head 16 of the second embodiment has a back edge 4, a doctor edge 5, and regulating boards 6 substantially similar to those of the coating head 1 shown in FIG. 1.

However, it should be noted that, instead of the recesses 12 rectangular in section (FIG. 1), a pair of recesses 17 which are triangular or V-shaped in section are provided at both ends of the back edge 4 and of the doctor edge 5 confronting the coating-solution-free portions of the web 2 and extending in the direction of running of the web 2, thus providing shoulders 8 to the outside of the recesses 17. The shoulders 8 serve to support both edge portions of a web 2.

In the extrusion-type coating head 16, similar to the case of the extrusion-type coating head 1 described above, the coating-solution-free portions of the web, which are provided to the outside of the coating layer 10, will not be brought into contact with the back edge 4 and the doctor edge 5. Accordingly, the coating head 16 is also free from the difficulty that the thickness of the coating solution applied to the web is not uniform in the direction of width.

In one of the above-described embodiments of the invention, the recesses formed at the ends of the back edge and the doctor edge of the coating head are rectangular in section, while they are triangular in section in the other embodiment. However, the invention is not limited thereto or thereby. That is, the recesses may have a different sectional configuration from those in the above-described embodiments.

While the invention has been described with reference to an extrusion-type coating head, the technical concept of the invention is applicable to other coating apparatuses in which a coating solution is applied to a web which runs continuously with the slot of a coating head abutted thereagainst.

As described above, in accordance with the invention, in applying a coating solution to a flexible support, the edge portions of the flexible support are supported in such a manner that, of the coating-solution-free portions of the flexible support, at least the parts close to the coating region are not brought into contact with the end portions of the top active part of the coating head.

Hence, even in the case of a relatively thin flexible support, the difficulties accompanying the coating-solution-free portions of the web on both sides of the coating portion being scraped by the top active part of the coating head and foreign matter on the flexible support being caught by the ends of the coating head are prevented. That is, the coating apparatus of the invention is free from the difficulty of foreign matter accumulating at both ends of the coating head and thereby raising the ends, causing the thickness of the coating solution applied to the web, and accordingly the resultant coating layer, to not be uniform in the widthwise direction.

Accordingly, in the coating method and apparatus of the invention, the coating layer formed on the web is uniform in thickness and excellent in surface quality, and the coating solution applied to the web will not flow over the web.

Further embodiments of the invention will now be described with reference to FIGS. 4, 5 and 6.

Figure 4:
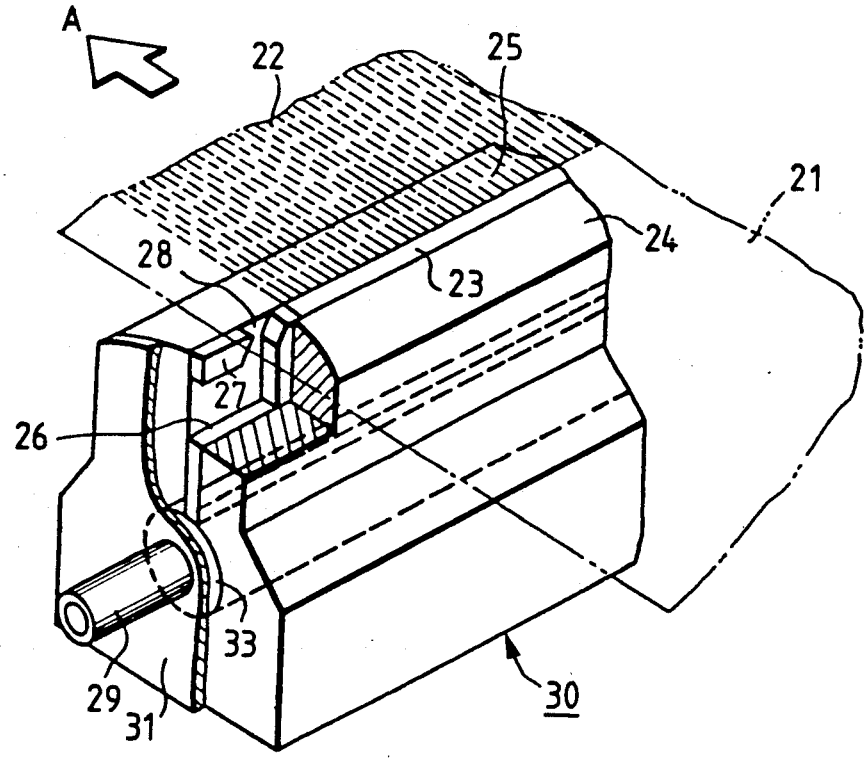
FIGS. 4 and 5 are a perspective view and a sectional view, respectively, showing a part of an extrusion-type coating head in a coating apparatus according to another embodiment of the invention.
Figure 5:
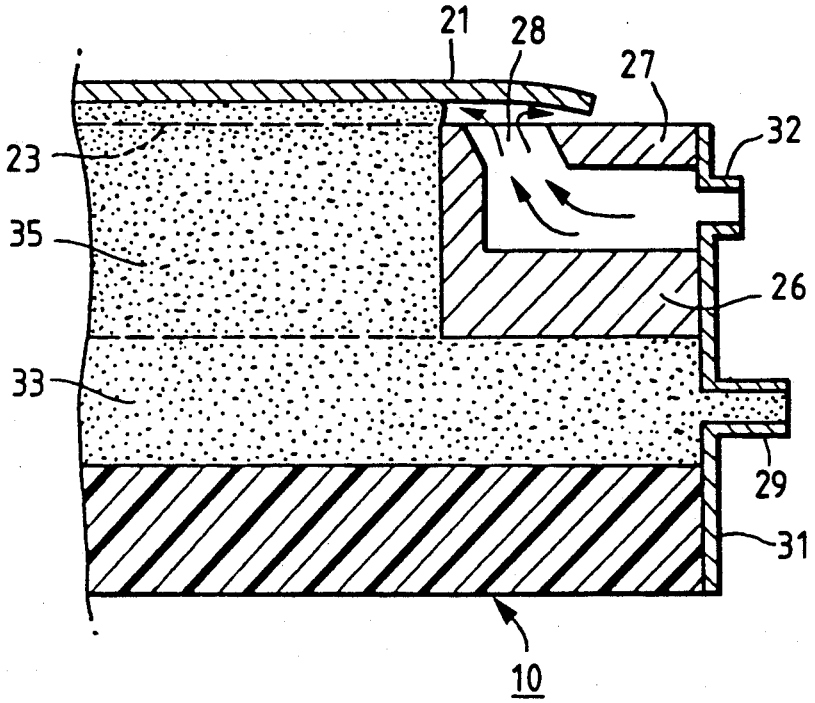
Figure 6:
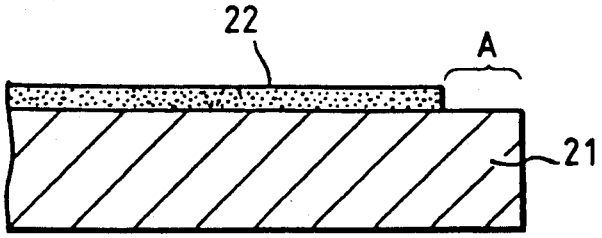
FIG. 6 is an enlarged sectional view showing the formation of a coating layer on a belt-shaped flexible support using the coating apparatus of FIG. 5.

FIGS. 4 and 5 are a perspective view and a sectional view, respectively, showing a part of an extrusion-type coating head 30 in a coating apparatus constructed according to a third embodiment of the invention.

As shown in FIGS. 4 and 5, the coating head 30 is larger in width than a flexible support (web) 21, and includes a back edge 24 and a doctor edge 25 which form a slot 23 through which a coating solution 35 is discharged over the width of the web. The slot 23 is communicated with a coating solution pool 33 provided inside the coating head 21. In order to supply the coating solution 35 into the coating solution pool 33, a coating solution supplying outlet 29 is provided in a side board 31 disposed beside the coating solution pool 33. Thus, the coating solution 35 thus supplied is discharged through the slot 23 under uniform pressure over its width.

Two coating-width regulating boards 26 are provided at respective ends of the slot 23 to define a coating width, that is, to prevent application of the coating solution 35 beyond the coating width. Accordingly, the web will have portions along its two edges coating-solution-free portions to which no coating solution is applied.

A pair of spacers 27 are provided above the coating width regulating boards 26 so as to form air jetting outlets 28 which are communicated with compressed air supplying inlets 32 formed in the above-described side boards 31. More specifically, the air jetting outlets 28 are formed so that they jet air upward, i.e., towards the coating-solution-free portions of the web. The air jetting direction and the opening area of each of the air jetting outlets 28 are determined from the pressure and the flow rate of air supplied by an air blower (not shown).

Hence, with the above coating apparatus, in forming a coating layer 22 on the running web 21 by applying the coating solution 35 with the slot of the coating head 30 abutted against the web 21, the coating-solution-free portions of the web 21 on both sides of the coating layer 22 are raised by the compressed air supplied through the air jetting outlets 28 so that they are prevented from contacting the back edge 24 and the doctor edge 25 of the coating head 30. In other words, the coating apparatus of the invention is free from the difficulties that occur when the coating-solution-free portions of the web are scraped by the back edge 24 and the doctor edge 25, or when foreign matter on the web 21 is caught by the edges 24 and 25 and accumulated along the edge portions of the coating layer 22, which raises the edge portions and causes the magnetic coating solution 35 applied to the web 21 to be nonuniform in thickness in the direction of width.

The pressure of the compressed air is regulated by a pressure control valve or the like to a preferred pressure in a range of 0.01 to 5 kg/cm$^2$ gauge depending on the coating rate and the web thickness. The flow rate is also controlled by a flow control valve. Therefore, even if the web 21 is thin, that is, low in rigidity, the edge portions of the web 21 are raised by the compressed air, thereby eliminating the difficulty of both edge portions of the web being bent towards the ends of the coating, causing the coating head to contact and scrape the edge portions.

In the above-described embodiment, compressed air is used to raise both edge portions of the web 21. However, the invention is not limited thereto or thereby. For instance, other gases such as nitrogen may be employed for the same purpose. In any case, it is preferable that the gas be dehumidified and kept at room temperature to prevent moisture for condensing on the web.

A fourth embodiment of the invention employs an extrusion-type coating head using a solvent instead of compressed air. This embodiment will now be described in more detail.

The extrusion-type coating head is similar in construction to that 30 shown in FIG. 4. In forming a coating layer 32 on a web 21 by applying a magnetic coating solution 35 with the slot of the coating head abutted against the web 21, instead of the air blower, a constant flow rate pump or a pressurizing tank is used to jet solvent through the outlets 28. In this case, the coating-solution-free portions beside the coating layer 22 are raised by the jetted solvent so that they cannot contact the coating head. Hence, in this embodiment as well the coating apparatus is also free from the difficulties encountered when the coating-solution-free portions of the web are scraped by the back edge 24 and the doctor edge 25, or foreign matter on the web 21 is caught by the edges 24 and 25.

The thickness of the solvent layers formed on the edge portions of the web is determined according to the thickness of the coating layer 22 formed thereon. More specifically, the thickness is determined by adjusting the speed of the constant flow pump or the pressure of the pressurizing tank. The width of the solvent layers is positively regulated by the spacers 27 at both ends of the coating head. Therefore, the solvent applied to the web will not spread into the coating layer, nor flow over to the rear side of the web.

The solvent may be water or an organic solvent. However, it is preferable to use a solvent having a surface tension of 20 to 40 dyne/cm. In addition, in order to avoid the mixing of the solvent and the magnetic coating solution 35, the solubility parameters (SP values) of the two should differ by at least one (1) from each other. Furthermore, in order to make the solvent viscous, the solvent may contain solid materials to some extent. In order to decrease the solvent supplying pressure and to allow the solvent to quickly dry, the viscosity of the solvent should be made to less than 50 cp, preferably less than 30 cp, more preferably less than 10 cp.

As in the case of the first described embodiments, the above embodiments of the invention have been described with respect to a method for forming a magnetic layer on a belt-shaped flexible support to manufacture a magnetic recording medium, the invention is not limited thereto or thereby. That is, the technical concept of the invention is equally applicable to the case where a photosensitive layer is formed on a flexible support to manufacture photographic photosensitive materials.

As described above, with the coating apparatus of the above-described embodiment, a coating solution is applied to a belt-shaped flexible support while both edges of the latter are raised by a fluid so that, of the edge portions of the belt-shaped flexible support, at least the parts close to the coating portion are prevented from being brought into sliding contact with the end portions of the coating head.

Hence, the coating apparatus is free from the difficulties which occur when the coating-solution-free portions of the belt-shaped support located on both sides of the coating portion of the support are scraped by the end portions of the coating head, or foreign matter on the web 21 is caught by the latter.

Thus, the coating method and apparatus of the invention can form a coating layer on a belt-shaped flexible support which is uniform in thickness and which has an excellent surface quality, and which is free from the difficulty of the coating solution applied to the flexible support spreading beyond the area which is intended to be coated.

As conducive to a full understanding of the invention, Inventive Examples of the above embodiments will be described.

INVENTIVE EXAMPLES 2

Components as indicated in the following Table 3 were sufficiently mixed and dispersed with a ball mill to form a mixture. The mixture was sufficiently mixed with 30 parts of epoxy resin by weight to prepare a magnetic coating solution. The magnetic coating solution was applied to polyethylene terephthalate supports 501 mm, 502 mm, 506 mm and 510 mm in width and 15 μm, 38 μm and 75 μm in thickness with coating quantities of 15 cc/m², 20 cc/m², 30 cc/m² and 40 cc/m², respectively, and with a coating rate of 200 m/min, coating tension of 10 kg/500 mm (width), and coating width of 500 mm. In this case, the supports had coating-solution-free portions on the coating sides thereof having widths of 0.5 mm, 1 mm, 3 mm and 5 mm, respectively.

TABLE 3

| Composition: | |
|---|---|
| Co containing magnetic iron oxide ($S_{BET}$ 35 m²/g) | 100 parts by weight |
| Nitrocellulose | 10 parts by weight |
| Polyurethane resin (Nipporan-2304 manufactured by Nippon Polyurethane Co., Ltd.) | 8 parts by weight |
| Polyisocyanate (Coronate L manufactured by Nippon Polyurethane Co., Ltd.) | 8 parts by weight |
| $Cr_2O_3$ | 2 parts by weight |
| Carbon black (average grain size 20 μm) | 2 parts by weight |
| Stearic acid | 1 part by weight |
| Butyl stearate | 1 part by weight |
| Methylethyl ketone | 150 parts by weight |
| Butyl acetate | 150 parts by weight |

The extrusion-type coating head of the coating apparatus was as shown in FIG. 4. The configuration of the coating head was as disclosed in Japanese Unexamined Published Patent Application No. 238179/1985, and the curved part of the doctor edge of the coating head had a radius of curvature of 5 mm. Compressed air was jetted through the fluid jetting outlets 28 provided in the coating head 30 under pressures of 0.01 kg/cm², 0.1 kg/cm², 0.5 kg/cm², 1.0 kg/cm², 3.0 kg/cm² and 5.0 kg/cm² (gauge pressure).

Specimens 1 through 16, magnetic recording media 6000 m in length, were manufactured under the above-described conditions. The state of the coating head was observed for scrapings stuck to the end portions thereof, and the thicknesses of both end portions of the coating layer in the direction of width were measured at the start of each coating operation and at the end of the coating operation to detect the difference therebetween. The results were as indicated in the following Table 4.

COMPARISON EXAMPLES 3

Specimens 17 through 26, magnetic recording media 6000 m in length, were manufactured as Comparison Examples under the same coating conditions as those in the above-described Inventive Examples 2, except that no compressed air was jetted through the fluid jetting outlets. In this case, too, the state of the coating was observed for scrapings stuck to the end portions thereof, and the thicknesses of both end portions of the coating layer in the direction of width were measured at the start of each coating operation and at the end of the coating operation to detect the difference therebetween. The results were as indicated in the following Table 4.

TABLE 4

| Spec. No. | Web Thickns. | Coating Quantity | Width of Coating-Sol.-Free Portion | Applied Pressure (kg/cm²) | Amt. Scrapings | Coating Layer Thickns. |
|---|---|---|---|---|---|---|
| Inventive Exs. 2 | | | | | | |
| 1 | 15 | 15 | 0.5 | 0.5 | ○ | ○ |
| 2 | 15 | 15 | 1 | 0.5 | ○ | ○ |
| 3 | 15 | 15 | 3 | 0.5 | ○ | ○ |
| 4 | 15 | 15 | 5 | 0.01 | Δ | ○ |
| 5 | 15 | 15 | 5 | 0.1 | ○ | ○ |
| 6 | 15 | 15 | 5 | 0.5 | ○ | ○ |
| 7 | 15 | 15 | 5 | 1.0 | ○ | ○ |

TABLE 4-continued

| Spec. No | Web Thickns | Coating Quantity | Width of Coating-Sol.-Free Portion | Applied Pressure (kg/cm²) | Amt. Scrapings | Coating Layer Thickns. |
|---|---|---|---|---|---|---|
| 8 | 15 | 15 | 5 | 3.0 | ○ | ○ |
| 9 | 15 | 20 | 3 | 0.5 | ○ | ○ |
| 10 | 15 | 30 | 3 | 0.5 | ○ | ○ |
| 11 | 15 | 40 | 3 | 0.5 | ○ | ○ |
| 12 | 38 | 15 | 3 | 1.0 | ○ | ○ |
| 13 | 38 | 20 | 3 | 3.0 | ○ | ○ |
| 14 | 75 | 15 | 3 | 1.0 | ○ | ○ |
| 15 | 75 | 15 | 3 | 3.0 | ○ | ○ |
| 16 | 75 | 15 | 3 | 5.0 | ○ | ○ |
| Comp. Exs. 3 | | | | | | |
| 17 | 15 | 15 | 0.5 | — | Δ | Δ |
| 18 | 15 | 15 | 1 | — | X | XX |
| 19 | 15 | 15 | 3 | — | XX | XX |
| 20 | 15 | 15 | 5 | — | XX | XX |
| 21 | 15 | 20 | 3 | — | X | X |
| 22 | 15 | 30 | 3 | — | Δ | ○ |
| 23 | 15 | 40 | 3 | — | Δ | Δ |
| 24 | 38 | 15 | 3 | — | X | X |
| 25 | 38 | 20 | 3 | — | Δ | Δ |
| 26 | 75 | 15 | 3 | — | Δ | Δ |

Legend Coating layer thickness change
○ — no scrapings
Δ — not many scrapings
X — many scrapings
XX — great many scrapings
Legend Coating layer thickness change
○ — no change
Δ — change less than 0.01 μm
X — change less than 0.2 μm
XX — change more than 0.2 μm (inclusive)

INVENTIVE EXAMPLE 3

Components as indicated in the above-described Table 3 were sufficiently mixed and dispersed with a ball mill to form a mixture. The mixture was sufficiently mixed with 30 parts of epoxy resin by weight (equivalent epoxy 500) to prepare a magnetic coating solution. The magnetic coating solution was applied to a polyethylene terephthalate support 500 mm in width and 37 μm thick with a coating quantity of 17 cc/m², coating rate of 200 m/min, coating tension of 10 kg/500 mm (width), and coating width of 490 mm. In this case, the support had coating-solution-free portions on the coating side thereof which were each 5 mm in width.

The extrusion-type coating head of the coating apparatus was as shown in FIG. 4. The configuration of the coating head was as disclosed by Japanese Unexamined Published Patent Application No. 238179/1985, and the curved part of its doctor edge had a radius of curvature of 5 mm. The openings of the fluid jetting outlets 28 were made smaller by 1 mm in width, in the direction of coating width, than the respective coating-solution-free portions of the web.

Specimens 27 through 46, magnetic recording media 6000 m in length, were manufactured under the above-described coating conditions, while the solvent jetted through the fluid jetting outlets 8 was changed in kind, flow rate and viscosity as indicated in the following Table 5. At the end of each coating operation, the scraping of the coating-solution-free portions of the web, the spreading of the coating solution, and the conditions of the interface of the coating solution and the solvent were observed. The results of the observations were as indicated in the following Table 5. The viscosities of Specimens 39 through 46 were adjusted by adding vinyl chloride - vinyl acetate copolymer to the methylethyl ketone.

COMPARISON EXAMPLE 4

A comparison example, a magnetic recording medium 6000 m in length, was manufactured under the same conditions as those in Inventive Example 3, except that no solvent was jetted through the fluid jetting outlets 28. At the end of the coating operation, the amount of scraping of the coating-solution-free portions of the web, the spreading of the coating solution, and the conditions of the interface of the coating solution and the solvent were observed. The results of the observations are as indicated in the following Table 5.

COMPARISON EXAMPLE 5

A coating apparatus with an extrusion-type coating head whose ends were not machined, as disclosed in Japanese Unexamined Published Patent Application No. 84771/1982, was used to manufacture Comparison Example 5, a magnetic recording medium 6000 m in length, under the same conditions as those in Inventive Example 4. At the end of the coating operation, amount of scraping of the coating-solution-free portions of the web, the spreading of the coating solution, and the conditions of the interface of the coating solution and the solvent were observed. The results of the observations are as indicated in the following Table 5.

COMPARISON EXAMPLE 6

The coating method employed to manufacture Comparison Example 6 was that disclosed in Japanese Unexamined Published Patent Application No. 257268/1986 in which, before application of the coating solution to a support, both edge portions of the support located on both sides of a coating portion to which the coating solution is to be applied are applied with a solvent. A magnetic recording medium 6000 m in length was thereby manufactured under the same conditions as those in Inventive Example 3. At the end of the coating operation, the amount of scraping of the coating-solution-free portions of the web, the spreading of the coating solution, and the conditions of the interface of the coating solution and the solvent were observed. The results of the observations are as indicated in the following Table 5.

COMPARISON EXAMPLE 7

The coating apparatus as disclosed by Japanese Patent Application (OPI) No. 257263 which uses an extrusion type coating head whose doctor edge has a chamfered end was used to manufacture Comparison Example 7, a magnetic recording medium 6000 m in length under the same conditions as those in Inventive Example 3. And at the end of the coating operation, the scraping of the coating-solution-free portions of the web, the spreading of the coating solution, and the conditions of the interface of the coating solution and the solvent were observed. The results of the observations are as indicated in the following Table 5:

TABLE 5

| Spec. No. | Solv. | Coating Quan. (cc/m²) | Visc. (cp) | Amt. Scrapings | Spreading | Interface of Coating Sol. & Solv. |
|---|---|---|---|---|---|---|
| Inventive Exs. 3 | | | | | | |
| 27 | Isooctane | 5 | 0.75 | ○ | ○ | ○ |
| 28 | Acetone | 5 | 4.6 | ○ | ○ | ○ |
| 29 | Methylcellosolve | 5 | 0.59 | ○ | ○ | ○ |
| 30 | Methanol | 5 | 0.79 | ○ | ○ | ○ |
| 31 | Water | 5 | 1.0 | ○ | ○ | ○ |
| 32 | Methylethyl | 0.5 | 0.40 | X | ○ | ○ |
| 33 | ketone | 0.8 | 0.40 | Δ | ○ | ○ |
| 34 | " | 1 | 0.40 | ○ | ○ | ○ |
| 35 | " | 5 | 0.40 | ○ | ○ | Δ |
| 36 | " | 8.5 | 0.40 | ○ | ○ | Δ |
| 37 | " | 17 | 0.40 | ○ | Δ | Δ |
| 38 | " | 25 | 0.40 | ○ | X | X |
| 39 | Methylethyl | 5 | 3 | ○ | ○ | ○ |
| 40 | ketone + | 5 | 5 | ○ | ○ | ○ |
| 41 | vinyl | 5 | 10 | ○ | ○ | ○ |
| 42 | chloride | 5 | 20 | ○ | ○ | ○ |
| 43 | " | 5 | 30 | ○ | ○ | ○ |
| 44 | " | 25 | 50 | ○ | Δ | ○ |
| 45 | " | 5 | 50 | ○ | ○ | ○ |
| 46 | " | 25 | 50 | ○ | Δ | ○ |
| Comp. Exs. | | | | | | |
| 4 | — | — | — | XX | — | — |
| 5 | — | — | — | XX | — | — |
| 6 | Methyethyl ketone | 2 | 0.40 | ○ | X | X |
| 7 | — | — | — | XX | — | — |

Legend: Scraping
○ — surface not scratched nor scraped - satisfactory
Δ — surface scratched - useful in practice
X — scrapings found on surface and coating layer thickness nonuniform - unsatisfactory
XX — many scrapings found on surface and coating layer thickness greatly nonuniform - unacceptable
Legend: Spreading
○ — no spreading - satisfactory
Δ — spreading found, but not to the rear side - useful in practice
X — spreading to the rear side - unsatisfactory
Legend: Interface of coating solution and solvent
○ — no solvent enters coating solution - satisfactory
Δ — solvent enters coating solution - useful in practice
X — solvent enters coating solution - unacceptable As is apparent from Table 5, when compared with Comparison Examples 4 through 7, the amount of scrapings for Specimens 27 through 46 manufactured with the coating apparatus of the invention was less, and they are improved in the thickness of both edge portions of the coating layer with respect to the average thickness of the latter, and are free from difficulties attributed to spreading of the solvent.

What is claimed is:

1. A coating method comprising the steps of:

continuously running a flexible support with the slot of a coating head abutted against said flexible support, said coating head having a doctor edge portion and a back portion, said doctor edge portion being forward of said back edge portion in a direction of travel of said flexible support, said slot being defined between said doctor edge portion and said back edge portion;

applying coating solution to said flexible support with said coating head through said slot;

supporting edges of said flexible support on said coating head so that, of both edge portions of said flexible support to which no coating solution is applied, first parts which are close to a coating portion of said flexible support are held out of sliding contact with both ends of said coating head by recesses formed in said both ends of said coating head, and second parts outside of said first parts are supported by shoulder portions of said head formed outside said recesses; and blocking the flow of said coating solution through said slot in areas adjacent said edge portions of said flexible support to which no coating solution is applied to thereby define a coating width with a pair of regulating boards disposed between said doctor edge portion and said back edge portion.

2. The method of claim 1, wherein said recesses are rectangular in cross section.

3. The method of claim 1, wherein said recesses are triangular in cross section.

4. The method of claim 1, further comprising the step of applying a solvent to said shoulder portions of said coating head outside said recesses to lubricate running of said edge portions of said flexible support.

5. The method of claim 4, wherein said solvent is selected from the group consisting of butyl acetate and methylethyl ketone.

6. A coating method comprising the steps of:

continuously running a flexible support with the slot of a coating head abutted against said flexible support, said coating head having a doctor edge portion and a back portion, said doctor edge portion being forward of said back edge portion in a direction of travel of said flexible support, said slot being defined between said doctor edge portion and said back edge portion;

applying coating solution to said flexible support with said coating head through said slot;

supporting edges of said flexible support on said coating head by jetting a fluid through said coating head towards said edges of said flexible support so that, of both edge portions of said flexible support to which no coating solution is applied, parts which are close to a coating portion of said flexible support are held out of sliding contact with both ends of said coating head; and blocking the flow of said coating solution through said slot in areas adjacent said edge portions of said flexible support to which no coating solution is applied to thereby define a coating width with a pair of regulating boards disposed between said doctor edge portion and said back edge portion.

7. The method of claim 6, wherein said fluid comprises air.

8. The method of claim 6, wherein said fluid comprises nitrogen.

9. The method of claim 6, wherein said fluid comprises a solvent.

10. The method of claim 9, wherein a viscosity of said solvent is less than 50 cp.

11. The method of claim 9, wherein a viscosity of said solvent is less than 30 cp.

12. The method of claim 9, wherein a viscosity of said solvent is less than 10 cp.

13. The method of claim 9, wherein a surface tension of said solvent is in a range of 20 to 40 dyne/cm.

14. In a coating apparatus in which a coating solution is applied to a continuously running flexible support from a coating head abutted against said support, the improvement wherein a coating solution is extruded through a slot of said coating head, a pair of recesses are provided at both ends of said coating head in such a manner that said recesses confront both edge portions of said flexible support to which no coating solution is applied, said recesses extending in a direction of running of said flexible support, a pair of shoulders are provided which define said recesses at the ends of said coating head, said shoulders supporting both edges of said flexible support, which are uncoated, and a pair of regulating boards is provided at both ends of said slot for defining a coating width.

15. The coating apparatus of claim 14, wherein said recesses are rectangular in cross section.

16. The coating apparatus of claim 14, wherein said recesses are triangular in cross section.

17. In a coating apparatus in which a coating solution is applied to a continuously running belt-shaped flexible support from a coating head abutted against said support, the improvement wherein a coating solution is extruded through a slot of said coating head, a pair of fluid jetting outlets for jetting fluid towards both edges of said flexible support are provided at both end portions of said coating head which confront respective edge portions of said flexible support to which no coating solution is applied, said fluid jetted through said fluid jetting outlets spacing the edge portions of said belt-shaped flexible support away from the end portions of said coating head to prevent said edge portions of said belt-shaped flexible support from being brought into contact with said end portions of said coating head, and a pair of regulating boards is provided at both ends of said slot for defining a coating width.

18. The coating apparatus of claim 17, wherein said fluid comprises air.

19. The coating apparatus of claim 17, wherein said fluid comprises nitrogen.

20. The coating apparatus of claim 17, wherein said fluid comprises a solvent.

21. The coating apparatus of claim 20, wherein a viscosity of said solvent is less than 50 cp.

22. The coating apparatus of claim 20, wherein a viscosity of said solvent is less than 30 cp.

23. The coating apparatus of claim 20, wherein a viscosity of said solvent is less than 10 cp.

24. The coating apparatus of claim 20, wherein a surface tension of said solvent is in a range of 20 to 40 dyne/cm.

* * * * *